US006293777B1

(12) United States Patent
Unsöld

(10) Patent No.: US 6,293,777 B1
(45) Date of Patent: Sep. 25, 2001

(54) HYDRAULIC POSITIVE DISPLACEMENT MACHINE

(75) Inventor: Manfred Unsöld, Rechtenbach (DE)

(73) Assignee: Hydraulik-Ring GmbH (DE)

( * ) Notice: Subject to any disclaimer, the term of this patent is extended or adjusted under 35 U.S.C. 154(b) by 0 days.

(21) Appl. No.: 09/552,070

(22) Filed: Apr. 19, 2000

(30) Foreign Application Priority Data

Apr. 19, 1999 (DE) ..... 199 17 593

(51) Int. Cl.[7] ..... F01C 19/08

(52) U.S. Cl. ..... 418/132; 418/170; 137/112; 137/111

(58) Field of Search ..... 418/132, 170; 137/111, 112

(56) References Cited

U.S. PATENT DOCUMENTS

| | | | | |
|---|---|---|---|---|
| 1,294,869 | * | 2/1919 | Bump | 418/206.4 |
| 4,187,871 | * | 2/1980 | Hendrickson | 137/112 |
| 4,416,598 | * | 11/1983 | Merz | 418/132 |
| 4,622,992 | * | 11/1986 | Sutherland | 137/111 |
| 5,354,188 | * | 10/1994 | Arbogast et al. | 418/132 |
| 6,050,081 | * | 4/2000 | Jansen et al. | 137/112 |

FOREIGN PATENT DOCUMENTS

| | | | | |
|---|---|---|---|---|
| 3919939 | * | 12/1990 | (DE) | 418/132 |
| 4322240 | * | 1/1995 | (DE) | 418/132 |
| 563661 | * | 10/1993 | (EP) | 418/132 |
| 58-093977 | * | 6/1983 | (JP) | 418/132 |
| 60-153490 | * | 8/1985 | (JP) | 418/159 |
| 5-001675 | * | 1/1993 | (JP) | 418/132 |

* cited by examiner

*Primary Examiner*—Thomas Denion
*Assistant Examiner*—Theresa Trieu
(74) *Attorney, Agent, or Firm*—Gudrun E. Huckett

(57) ABSTRACT

A hydraulic positive displacement machine has rotating conveying elements whose end faces are sealed by pressure plate. This pressure plate is loaded by a control valve with hydraulic pressure in order to adjust the size of the sealing gap. The control valve has a hollow piston in which a metering orifice is located. A return connector, a connector communicating with a consumer, and a hydraulic control connector connected to the pressure plate can be controlled by the hollow piston with its metering orifice.

16 Claims, 6 Drawing Sheets

HYDRAULIC POSITIVE DISPLACEMENT MACHINE

BACKGROUND OF THE INVENTION

1. Field of the Invention

The invention relates to a hydraulic positive displacement machine, especially a gear wheel machine, having a housing in which conveying elements, especially gear wheels, are supported by which hydraulic medium is taken in through an intake or suction opening and expelled under pressure via an outlet or pressure opening, and wherein the end faces of the gear wheels are sealed by at least one pressure plate. The hydraulic positive displacement machine further comprises a control device by which the pressure for loading the pressure plate into a sealing position can be adjusted. The invention also relates to such a control valve for controlling the hydraulic positive displacement machine.

2. Description of the Related Art

Gear wheel machines, for example, gear pumps, are used primarily in mobile hydraulics because they have a comparatively simple construction and allow relatively high pressures while being of minimal weight. A further advantage of gear wheel machines is that they can be employed in comparatively large rpm, temperature, and viscosity ranges.

In European patent document 0 445 529 B1 a gear pump is disclosed in which two gear wheels are rotatably supported in a housing. The displacement chambers are delimited by the meshing tooth flanks, the inner wall of the housing, and an axial plate or pressure plate. The latter is loaded on its backside by a hydraulic medium so that it contacts sealingly the end faces of the gear wheels. The pressure acting on the backside of the pressure plate can be adjusted by a control device in which a metering orifice embodied as a directional control valve and a three-port directional pressure regulator (pressure scale) cooperate. It is loaded in the sense of increasing the pressure at the backside by the pressure downstream of the metering orifice as well as a pressure spring and in the sense of a reduction of the pressure at the backside by the pressure upstream of the metering orifice. The pressure regulator (pressure scale) connects for this purpose a control connector connected to a pressure chamber on the backside of the pressure plate with the pressure outlet of the pump or with the tank, so that the sealing gap between the pressure plate and the end faces of the gear wheels is reduced or enlarged. For an enlarged sealing gap the hydraulic medium can flow directly from the high pressure side to the low pressure side so that the volumetric efficiency of the gear wheel machine can be reduced and, for example, the conveying volume or capacity of the gear pump can be adjusted as a function of the gap width. This means that by influencing the hydraulic medium pressure acting on the pressure plate an exact conveying flow regulation can be performed.

A problem of this configuration is that the pump housing must be comparatively complex since space for the directional control valve to the consumer and the pressure regulator (pressure scale) must be provided. Moreover, a separate pressure limitation valve must be provided in order to limit the maximum pressure.

In U.S. pat. No. 4, 014,630 a pump arrangement is disclosed in which a sealing plate is forced by a spring into the contact positioned on the conveying elements. The spring chamber is connected by a throttle bore to the displacement chamber of the pump arrangement so that the pressure plate is also hydraulically prestressed into its sealing position. The pressure acting on the pressure plate can again be adjusted by a control device via which the hydraulic medium can be returned to a tank. A disadvantage of this construction is that at all times hydraulic medium is removed through the throttle bore from the displacement chambers so that the volumetric efficiency is reduced. Moreover, the throughbore of the pressure plate can easily become clogged so that, correspondingly, a servicing of the pump arrangement is required.

SUMMARY OF THE INVENTION

It is therefore an object of the present invention to provide a hydraulic positive displacement machine, especially a hydraulic gearwheel machine, in which with minimal device-technological expenditure a sufficiently precise conveying flow regulation is possible. A further object is to provide a control valve which is suitable for such positive displacement machines.

In accordance with the present invention, this is achieved in that the control device has a control valve with a metering orifice bore that is provided in a piston and connects an inlet connector and an outlet connector, wherein the piston, on the one hand, is loaded by the pressure of the hydraulic medium upstream of the metering orifice bore and, on the other hand, by the pressure downstream of the metering orifice bore as well as the force of a pressure spring, and that via the piston, depending on the pressure differential, a control connector hydraulically connected to the pressure plate can be connected to a pressure connector (inlet connector and outlet connector) for the purpose of increasing the pressure and to a return connector for the purpose of decreasing the pressure.

In accordance with the present invention, the object in regard to the control valve is further achieved in that the control valve has a sleeve with an axial bore for receiving a piston, wherein a radial connector and a control connector in the form of radial bores open into the axial bore, wherein the axial bore, on the one hand, opens into the inlet connector and, on the other hand, into the outlet connector, wherein the piston is penetrated by a metering orifice bore connecting the inlet and outlet connectors and has control edges by which the connection of the control connector to the pressure connector (inlet connector and outlet connector) and the radial connector can be controlled for opening and closing.

The inventive positive displacement machine is preferably embodied as a gear wheel machine wherein the sealing of the displacement chamber at the end faces is realized by a pressure plate whose back side is loaded by a control pressure via a control valve. The control valve has a piston by which the volume flow to the consumer can be controlled and by which a control connector, hydraulically connected to the pressure plate, can be connected to a pressure connector or a return connector so that the pressure on the back side of the pressure plate can be increased or decreased. The piston is a hollow piston wherein the throughbore acts as a metering orifice so that one end face of the piston is loaded by the pressure downstream of the metering orifice and the other end face of the piston is loaded by the pressure upstream of the metering orifice.

This control valve is characterized by an extremely compact configuration so that the housing of the displacement machine can be of a very simple design.

In an especially preferred embodiment, the controlling action for opening and closing the control connector and the return connector of the control valve can be realized by two control edges of the piston positioned axially spaced to one another so that the piston with increasing volume flow can be brought into a control position in which by means of the control edges the control connector can be connected to the pressure connector or the return connector.

The piston is advantageously provided with a further control edge by which a flow cross-section upstream of the metering orifice bore can be connected to the return connector upon a sufficiently large movement of the piston away from the control position so that the pressure plate is relieved and a fast adaptation to conveying volume changes is possible.

The technological expenditure for manufacturing the piston is especially simple when the metering orifice is formed by a portion of the throughbore of the piston.

For damping the volume flow fluctuations or pressure fluctuations, one end portion of the piston can be designed to provide a damping gap with a circumferential wall of the axial bore receiving the piston, wherein pressure medium can pass through the damping gap when the piston moves axially.

With a corresponding configuration of the piston, the backside of the pressure plate can be loaded either with pressure upstream or downstream of the metering orifice bore. In the first case the hydraulic medium is guided via a radial bore upstream of the throttle cross-section of the metering orifice bore to the control connector, while in the latter case the hydraulic medium reaches the control connector via the spring chamber only after flowing through the metering orifice bore.

The invention can be especially advantageously used in connection with an internal gear wheel machine in which an eccentrically arranged hollow gear wheel meshes with a driven pinion and wherein the pressure plate seals at least partially the end faces of the internal gear wheel and the pinion. In this configuration it is especially preferred when the control valve is arranged radially outside of the high pressure area in the housing. The construction of the housing is especially compact when the control valve is then arranged in a tangentially extending pressure channel so that the pressure connector opens into the lateral surface of the housing.

Since for a lifted pressure plate the hydraulic medium is returned from the high pressure area into the low pressure area, the amount of sucked-in (intake) hydraulic medium can be reduced by the portion of the internally returned hydraulic medium. This reduction of the intake hydraulic medium allows to reduce the opening cross-section (surface area) of the suction opening (intake opening) to about one-third of the opening cross-section which would be required purely theoretically (i.e., as calculated) for the maximum volume flow. Expediently, the cross-sectional surface area of the intake opening is approximately 20% to 40% of the theoretical (calculated) surface area for a maximum conveying volume, and more preferred it is approximately 30% of the theoretical surface area.

The partial volume of the hydraulic medium flowing through the open return connector can be returned internally or to a tank.

Because of the internal return of the partial flow of conveying substance when the pressure plate is lifted off, the inventive gear wheel pump conveys only the required amount so that energy losses are minimized. Due to the simple construction with internal return, the mechanical losses resulting from complicated channel guiding and switching elements are substantially reduced in comparison to the aforementioned prior art. Due to the minimum number of mechanical components, the wear and tear in comparison to conventional pumps is substantially reduced so that the stability of the pump meets highest requirements.

DESCRIPTION OF THE PREFERRED EMBODIMENTS

Figure 1:
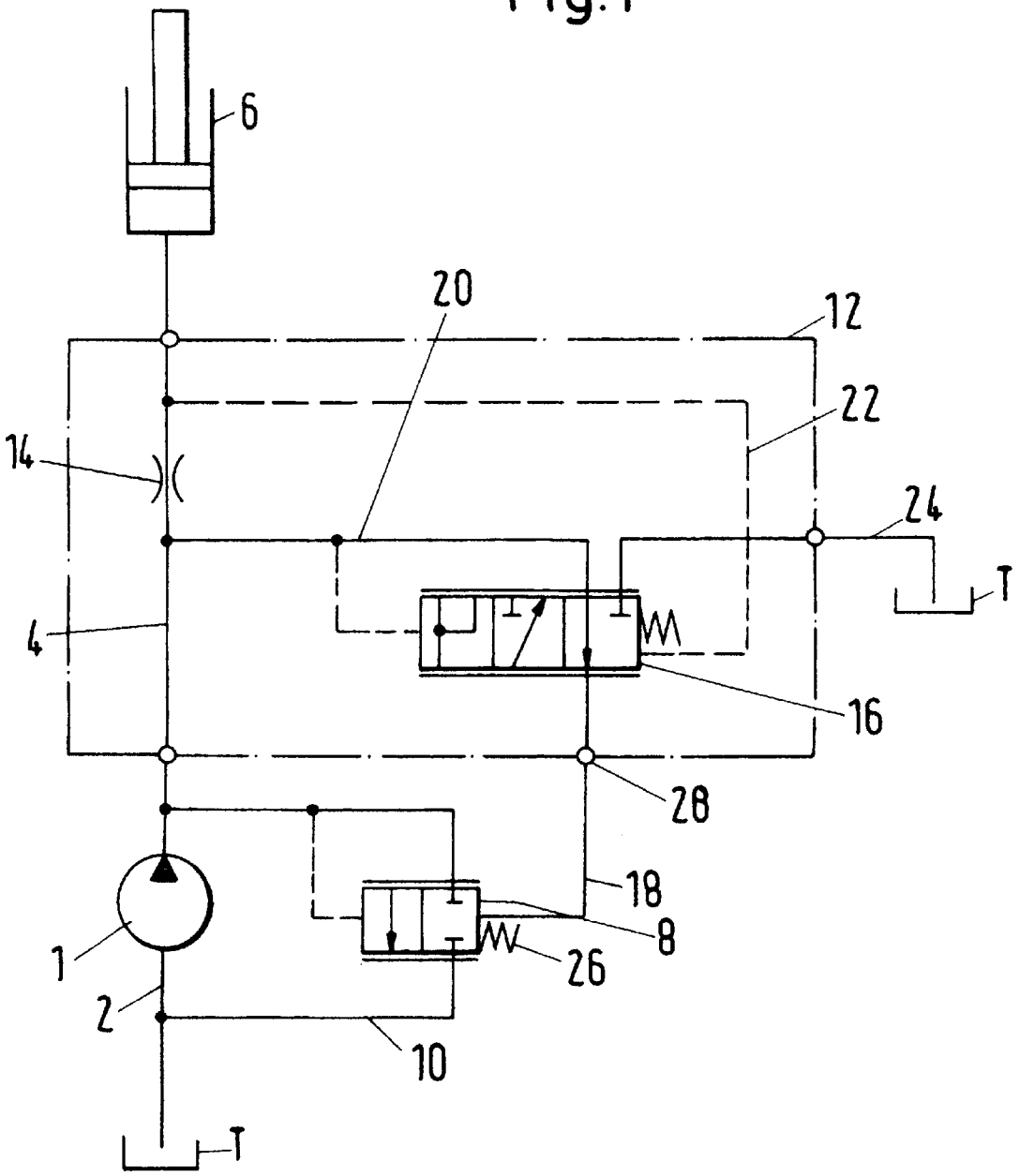
FIG. 1 illustrates a connection diagram of the internal gear wheel pump according to the invention.

FIG. 1 shows a connection diagram of a hydraulic positive displacement machine according to the invention which is, for example, designed as an internal gear wheel pump 1. Hydraulic medium is sucked in (taken in) by this pump via suction line or intake line 2 from the tank T, loaded with pressure, and then expelled via a pressure line 4 to a consumer, for example, a control cylinder 6 of a CVT transmission (continuous variable transmission).

The inner gear wheel pump is constructed according to a design which will be described in more detail in the following. In this design, the end face sealing action of the displacement chamber is realized by a pressure plate (see FIGS. 2 through 4). The pressure plate is loaded by a spring 26 as well as a hydraulic medium in the direction of its sealing position so that the sealing gap can be adjusted by adjusting the pressure on the backside of the pressure plate. The pressure plate has practically the function of the directional control valve illustrated in FIG. 1 and identified by reference numeral 8. FIG. 1 also shows a spring 26 which, in practice, can be realized by a seal which has a spring action and surrounds a pressure field on the backside of the pressure plate. When sufficient pressure acts on the back side of the pressure plate (directional control valve 8 in closed position), the displacement chamber is sealed at the end faces so that the internal gear wheel pump can convey a maximum volume flow. When the pressure onto the back side of the pressure plate is reduced (directional control valve 8 in flow connection), hydraulic medium can flow directly from the high pressure area into the low pressure area of the internal gear wheel pump I so that a kind of bypass channel 10 is opened. The pressure plate (directional control valve 8) in the lifting-off direction (opening direction) is loaded by the high pressure in the displacement chambers of the inner gear wheel pump 1 in the direction of its contact position (closed position) by a control pressure which is controlled by a control valve arrangement 12. This control pressure is present in the pressure field on the back side of the pressure plate wherein the pressure field has a surface area that is greater than the surface area on the front side of the pressure plate loaded by the pump pressure.

The control valve arrangement 12 has a metering orifice 14 which cooperates with a pressure regulator (pressure scale) 16 in the same way as in a flow control valve. In its spring-tensioned basic position the pressure regulator 16 connects the backside of the pressure plate via a control channel 18 with a line 20 opening into the pressure line 4 upstream of the metering orifice 14. The end face of the pressure regulator 16 is loaded by the pressure in the line 20 and acts counter to the pressure spring. The other end face is loaded, in addition to the pressure spring action, also with the pressure downstream of the metering orifice 14 via a control line 22.

With increasing conveying volume flow the pressure difference across the metering orifice 14 increases so that the pressure regulator 16 can be moved away from the illustrated basic position and the control channel 18 is then connected to a return channel 24 so that the hydraulic medium can be returned from the control channel 18 into a tank T or internally into the low pressure area of the internal gear wheel pump 1 (the after variant is not illustrated in the drawings).

This means that a comparatively minimal pressure difference across the metering orifice 14 controls the pressure regulator 16 such that the control valve provides a volume flow-dependent pressure at the control connector 28 which determines, for example, the pressure of the pressure plate 8. In principle, this control pressure could also be used for other tasks so that the use of the control valve arrangement 12 according to the invention is not limited to the pressing action of a pressure plate 8 to be disclosed in the following in more detail.

With increasing volume flow the piston of the pressure scale can be brought into a position in which a flow cross-section upstream of the metering orifice 14 and the backside of the pressure plate 8 are connected to the tank so that a fast conveying volume flow reduction can be performed.

Figure 2:
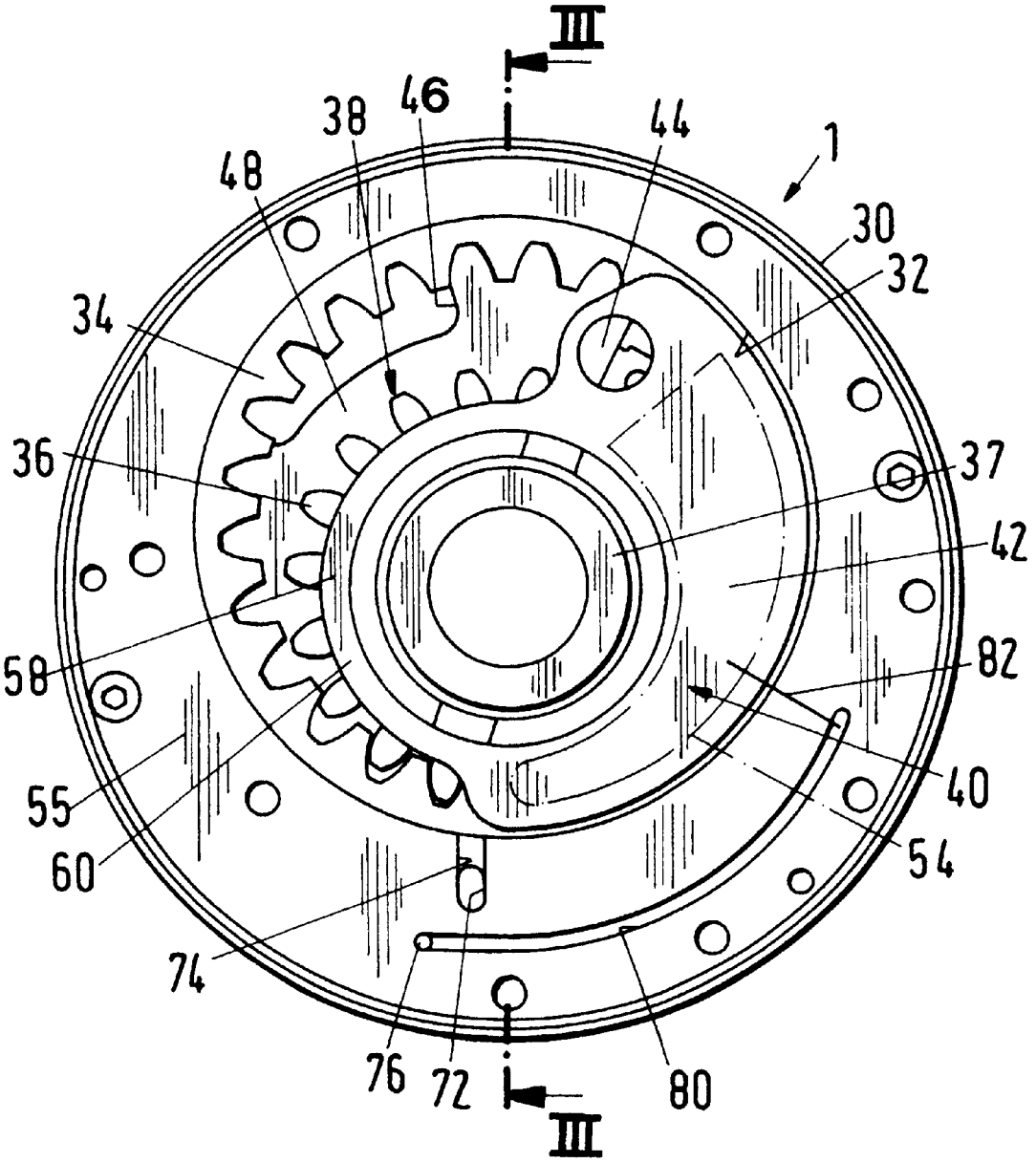
FIG. 2 is a side view of the internal gearwheel pump according to the invention without housing cover.
Figure 3:
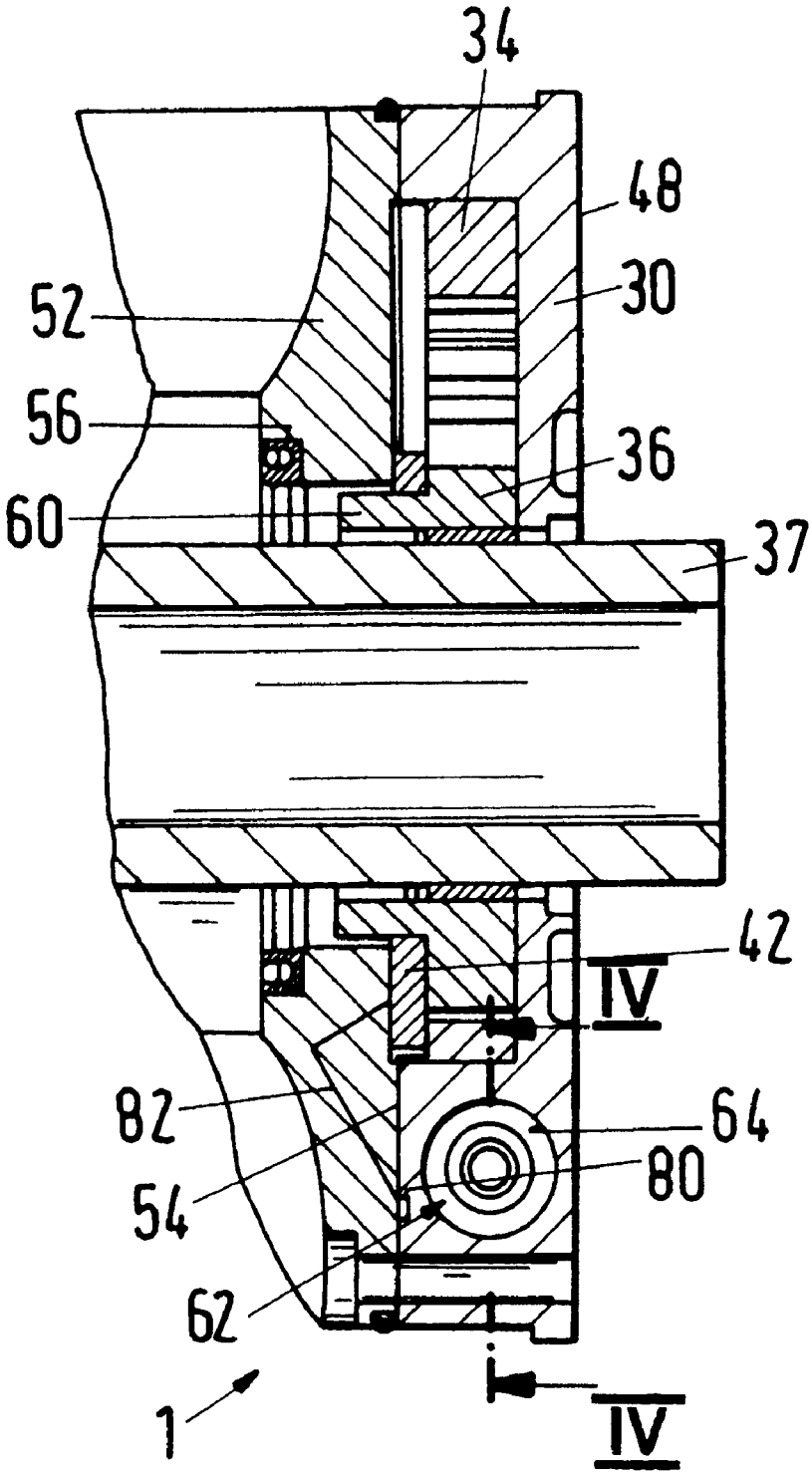
FIG. 3 is a sectional side view of the internal gearwheel pump of FIG. 2 (with housing cover)
Figure 4:
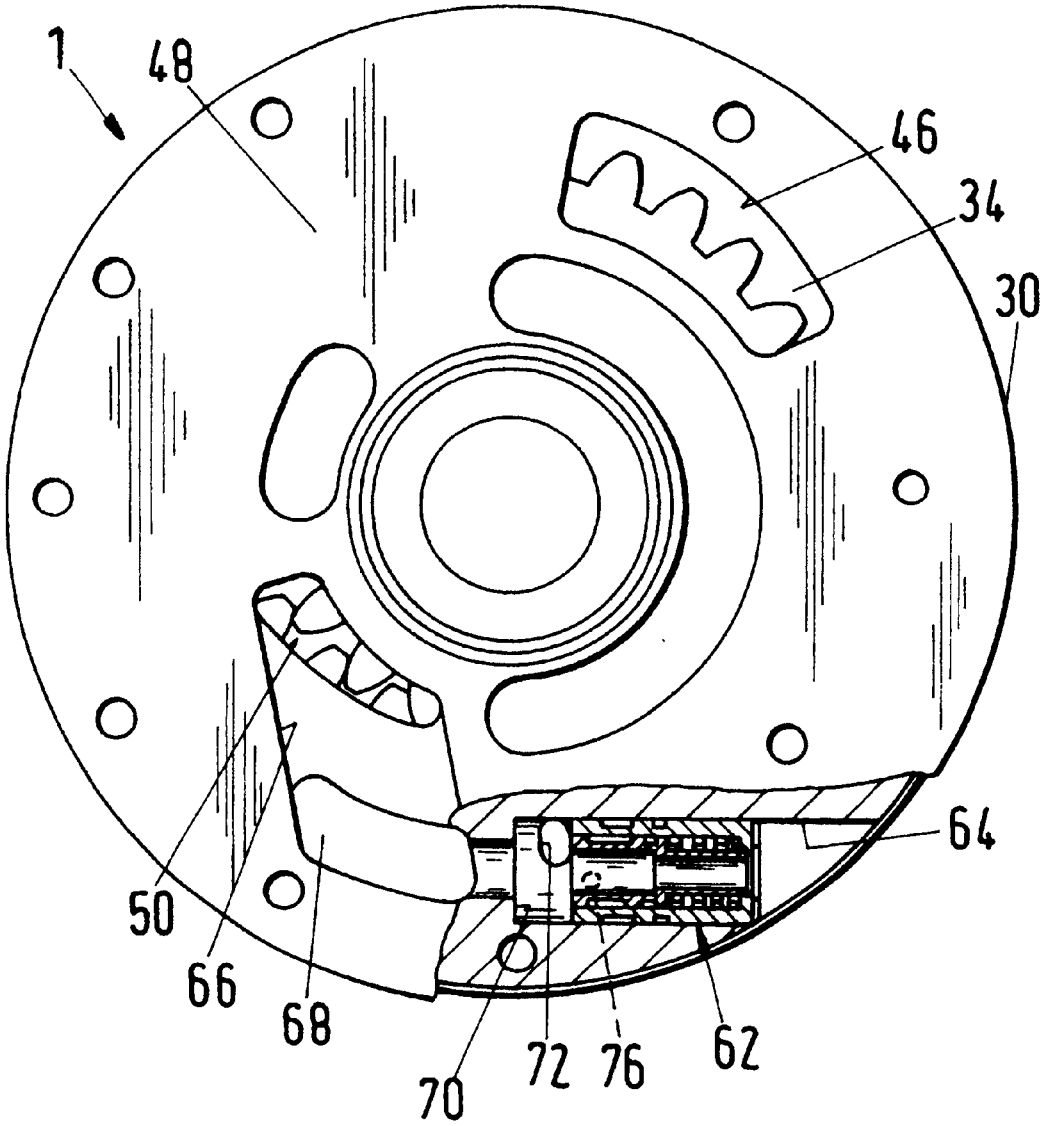
FIG. 4 is a rearview, partially in section, of the internal gear wheel pump of FIG. 2.

In FIGS. 2 through 4 an embodiment of an inner gear wheel pump 1 is illustrated wherein the aforementioned components, i.e., the inner gear wheel pump 1 with sealing plate 8 and the control valve arrangement 12, are integrated into a common housing.

FIG. 2 shows a front view, FIG. 3 shows a sectional side view, and FIG. 4 a partially sectioned rear view of the pump. The basic configuration of the inner gear wheel pump 1 is known already from the prior art, for example, from German patent 43 22 240 (owned by the assignee of the instant invention) so that in the following only the essential components will be discussed.

The internal gear wheel pump 1 has a cup-shaped housing 30 with an eccentrically arranged receptacle 32 for an internal gear wheel 34 which meshes with a centrally supported pinion 36 driven by a drive shaft 37 penetrating the housing 30. Because of the eccentric arrangement of the internal gear wheel 34 relative to the pinion 36, the space defined by the receptacle 32 can be divided into a low pressure area 38 and a high pressure area 40.

The closure of the high pressure area 40 at the end faces is realized by a pressure plate 42. In this high pressure area 40 the teeth of the internal gear wheel 34 and of the pinion 36 mesh with one another so that between two teeth a respective displacement space is provided which is delimited at the end faces by the pressure plate 42 and the bottom of the receptacle 32.

In the transition area between the low pressure area 38 and the high pressure area 40 a filler member (not shown) is arranged that is supported by a filler pin 44 on the housing. The filler member rests with its lateral surfaces on the teeth of the pinion 36 and of the internal gear wheel 34 so that the hydraulic medium in the gaps between the teeth can be guided along the filler member into the meshing tooth area (high pressure area 40). The supply of hydraulic medium into the low pressure area 38 is realized via the suction opening (intake opening) 46 in the end face 48 of the housing 30. The pressure-loaded hydraulic medium is removed through the pressure opening (outlet opening) 50 in the end face 48. As can be seen especially in FIG. 4, the suction (intake) opening 46 and the pressure (outlet) opening 50 have a substantially kidney-shaped cross-section wherein the suction opening 46 is arranged radially farther outwardly than the pressure opening 50 and has moreover a larger cross-sectional area.

FIG. 3 shows a section along the section line 111—111 of FIG. 2. Accordingly, the closure of the internal gear wheel pump 1 at the end faces is realized by a housing cover 52 which is screwed onto the flange surface 55 of the housing illustrated in FIG. 2. The housing cover 52 rests with a seal 54, indicated by a dashed line in FIG. 2, against the pressure plate 42. The seal 54 surrounds a pressure field which is loaded by high pressure in a manner to be disclosed in the following. By means of this pressure field the pressure plate 42, which is received axially with play between the housing cover 52 and the end faces of the internal gearwheel 34 and the pinion 36, is pretensioned into its contact position against the end faces (see FIG. 3).

Moreover, in the penetration area of the drive shaft 37 through the housing cover 52 a shaft seal 56 is arranged. The pinion 36 is fixedly connected to the drive shaft 37 or is a monolithic part therewith.

As can be seen especially in FIG. 2, the sealing plate (pressure plate) 42 surrounds with a bearing eye 58 a collar 60 of the pinion 36. This collar 60 extends toward the housing cover 52.

The filler pin 44 penetrates the pressure plate 42. As mentioned before, the pressure plate 42 can be moved in the axial direction so that the sealing gap between the end faces of the gear wheels 34, 36 and the contact surface of the sealing plate 42 is adjustable. This means that upon enlargement of the sealing gap hydraulic medium can flow directly from the high pressure area 40 into the low pressure area 38 so that the volumetric efficiency of the internal gear wheel pump 1 is reduced and, accordingly, the expelled volume flow can be adjusted by varying the sealing gap.

The pressure for pressing the sealing (pressure) plate 42 is adjusted by the control valve 62. This control valve 62 which acts as a flow regulator is of a cartridge construction and is inserted into a pressure channel 64 extending tangentially in the housing 30. The pressure channel 64 opens into a stepped pocket 66 in the end face 48 of the housing 30. The pocket 66 extends from the pressure opening 50 to a recessed kidney-shaped portion 68 into which the pressure channel 64 opens. This means that hydraulic medium can flow through the pressure opening 50 along the pocket 66 into the kidney-shaped portion 68 and from there into the tangentially extending pressure channel 64 which is practically the pressure connector of the internal gear wheel pump 1.

The pressure channel 64 has a contact shoulder 70 against which the control valve 62 rests in the mounted position. In the representation according to FIG. 4 the control valve 62 is still positioned at a spacing from the contact shoulder 70 so that a return channel 72 is visible which practically corresponds to the return channel 24 of FIG. 1.

According to FIG. 2 this return channel 72 ends in a substantially radially extending cut 74 in the flange surface 55 and opens into the circumferential wall of the receptacle 32.

According to FIGS. 2 and 4 a control channel 76 (indicated in dashed lines in FIG. 4) also opens into the tangentially extending pressure channel 64. This channel 76 corresponds to the control channel 18 in FIG. 1. The control channel 76 extends to a curved groove 80 in the flange surface 55 of the housing 30. This groove 80 cooperates with a connecting channel 82 (illustrated as a solid line in FIG. 2) in the housing cover 52 so that hydraulic medium can be supplied via the control channel 76, the groove 80, and the connecting channel 82 to the pressure field delimited by the seal 54 in order to load the sealing plate 42 in the direction of its contact position against the gear wheels 34, 36. The connecting channel 82 is an angular bore in the housing cover 52. Both bore sections can be drilled from the end face facing the housing 30 and extend at an obtuse angle relative to one another. This course of the connecting channel 82 is illustrated in FIG. 3 in solid lines.

The configuration of a first preferred embodiment of the control valve 62 will now be explained with the aid of FIG. 5.

The control valve 62 inserted into the pressure channel 64 is embodied as a cartridge arrangement and has a sleeve 84 in which a piston 88 is moveably guided in the corresponding axial bore 86. The right end portion of the axial bore 86 in FIG. 5 is recessed or stepped radially inwardly to form a damping bore 90.

Figure 5:
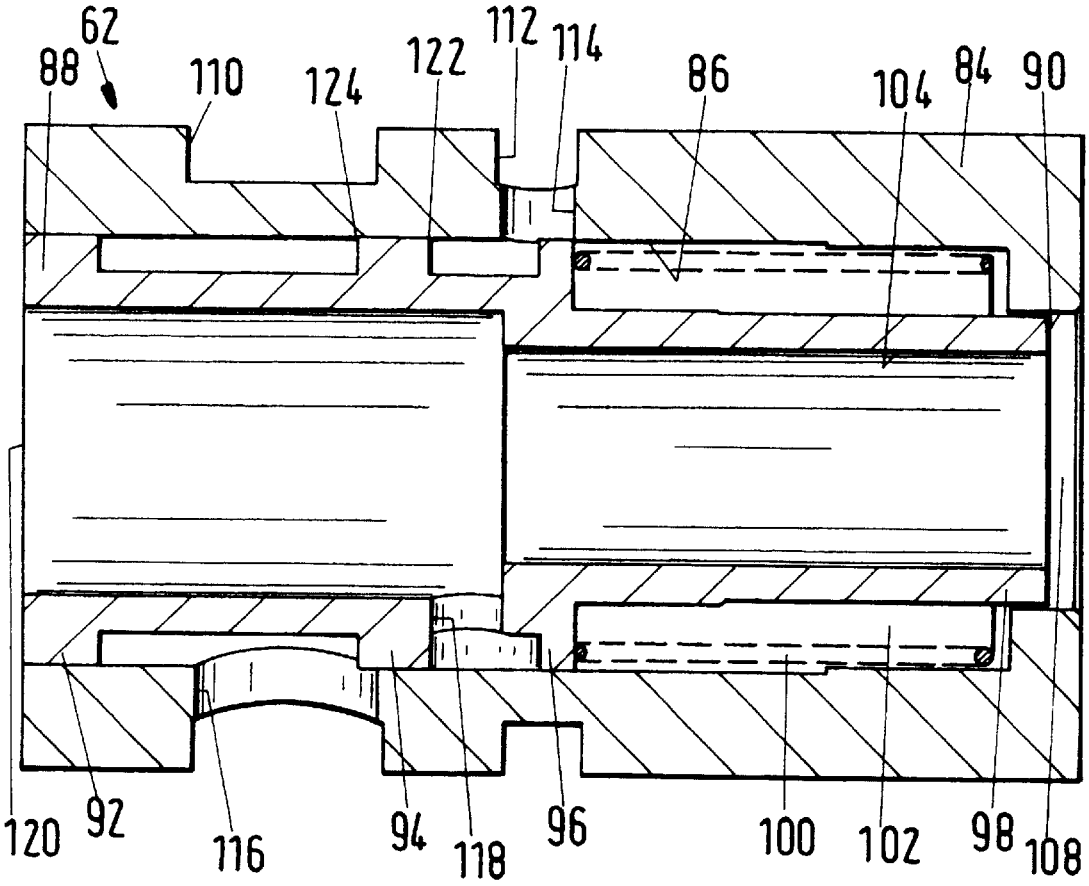
FIG. 5 is a first embodiment of a control valve for the internal gear wheel pump according to FIGS. 2 through 4.

The piston 88 arranged in the wide portion of the axial bore 86 has three axially spaced annular collars 92, 94, 96 wherein the annular collar 92 forms the left end face of the piston 88 in FIG. 5. Adjacent to the right annular collar 96 (see FIG. 5) the piston 88 is radially inwardly stepped or recessed. This radially recessed end portion 98 penetrates at least with a portion thereof the damping bore 90. The recessed portion 98 and the damping bore 90 together form a damping gap.

The piston 88 is biased by a spring 100 into the initial position represented in FIG. 5 wherein the pressure spring 100 is supported on the annular end face or shoulder of the radially recessed portion of the axial bore 86 and on the annular end face or shoulder of the annular collar 96.

Accordingly, the spring chamber 102 is connected by the damping gap between the damping bore 90 and the end portion 98 with the area downstream of the piston 88.

The piston 88 is a hollow piston and has a stepped throughbore whose right portion (FIG. 5) is embodied as a metering orifice bore 104. The inlet and outlet connectors 106 and 108 of the valve are formed by the mouth areas of the axial bore 86 of the sleeve 84 and define a pressure connector arrangement. The sleeve 84 has cross-sectional elements in the form of two axially spaced annular grooves 110, 112 wherein one or more radial bores forming a control connector 114 open into the annular groove 112 and one or more radial bores forming a return connector 116 open into the annular groove 110.

In the circumferential wall of the piston 88 a mantle bore 118 is provided which opens between the two annular collars 94, 96. On the collar 92 a control edge 120 is provided by which opening and closing of the connection from the connector 106 to the connector 116 can be controlled. In the control position of the piston 88 the annular collar 94 covers the connector 114 with zero overlap. On the annular collar 94 two control edges 122 and 124 are formed wherein the connector 114 can be connected via the control edge 112 to the connector 106 and via the control edge 124 to the connector 116. The connection between the control connector 114 and the spring chamber 102 is always closed off by the annular collar 96.

By means of the control valve 62 illustrated in FIG. 5 the metering orifice 14 (FIG. 1) and the pressure scale (regulator) 16 (FIG. 1) are practically combined into a single component of a simple configuration. In this context, the metering orifice (14) is formed by the metering orifice bore 104 of the piston 88, while the pressure scale or regulator (16) is formed by the piston 88 axially movable in the sleeve 84 whose end faces are loaded with the pressure differential across the metering orifice bore 104 and the force of the spring 100.

As mentioned above, the control valve 62 in the mounted position rests with its left end face (FIG. 5) against the contact shoulder 70 of the pressure channel 64. The control valve 62 is in a pressureless state in the initial position represented in FIG. 5. This means, the return connector 116 is closed off by the two annular collars 92, 94 while the control connector 114 is open to the connector 106. When the pressurized hydraulic medium flows through the control valve 62, a pressure drop results across the metering orifice bore 104 so that at the end faces of the piston 88 a pressure differential $\Delta p$ results. This means that on the left end face of the piston 88 the pressure of the pressure opening 50 of the internal gear wheel pump is present, while in the opposite direction the pressure downstream of the metering orifice as well as the force of the pressure spring 100 are acting. The piston 88 is brought into a control position that is determined by the pressure differential.

A partial stream of the hydraulic medium flowing through the piston 88 can flow via the mantle bore 118 into the control connector 114 and thus can be guided via the control channel 76, the groove 80, and the connecting channel 82 into the pressure field delimited by the seal 54. The pressure plate 42 is then practically forced by the pressure upstream of the piston 88 against the end faces of the gear wheels 34, 36.

With increasing volume flow the piston 88 is moved counter to the force of the pressure spring 100 by the pressure differential $\Delta p$ present between the end faces. After a predetermined axial movement, which corresponds to a limit volume flow, the piston 88 is in a control position in which, by a minimal movement into one or the other direction, the pressure in the pressure field at the back side of the pressure plate 42 can be lowered, so that the gap between the pressure plate 42 and the end faces of the gear wheels 34, 36 is enlarged, or the pressure can be increased so that the gap is reduced. A portion of the hydraulic medium is then internally returned in the afore described manner from the high pressure area 40 to the low pressure area 38 so that the volumetric efficiency of the pump is reduced.

Upon further increase of the volume flow the control connector 114 is opened wide relative to the connector 116 and by means of the control edge 120 the connector 106 is opened to the return connector 116 so that the area upstream of the metering orifice bore 104 is connected directly to the return channel 72. This return channel 72 can end in the low pressure area 38 or can be connected to the tank T. In the first mentioned case, the hydraulic medium is internally returned so that less hydraulic medium must be taken from the tank T.

With the internal return of the hydraulic medium with lifted-off pressure plate 42 and, if needed, with the connector 106 being opened relative to the return channel 116, it is possible to realize the suction (intake) opening 46 with a smaller opening cross-section than would be required theoretically (i.e., based on calculations) because only a partial volume flow of the hydraulic medium must be taken in through the suction opening while the other partial volume flow is returned directly from the high pressure area 40 into the low pressure area 38. Preliminary experiments have shown that the suction opening can be formed with approximately one-third of the theoretical surface area calculated for putting through the maximum conveying volume flow. With the inventive reduction of the suction opening cross-section the housing 30 of the internal gearwheel pump 1 can be of a more compact design with increased strength and stability.

In the embodiment represented in FIG. 5 fast axial movements of the piston 88, for example, caused by volume flow fluctuations or pressure fluctuations, are prevented by the damping gap because the hydraulic medium present in the spring chamber 102 can be displaced from the spring chamber 102 through this gap or must flow from the outlet connector 108 into it.

Figure 6:
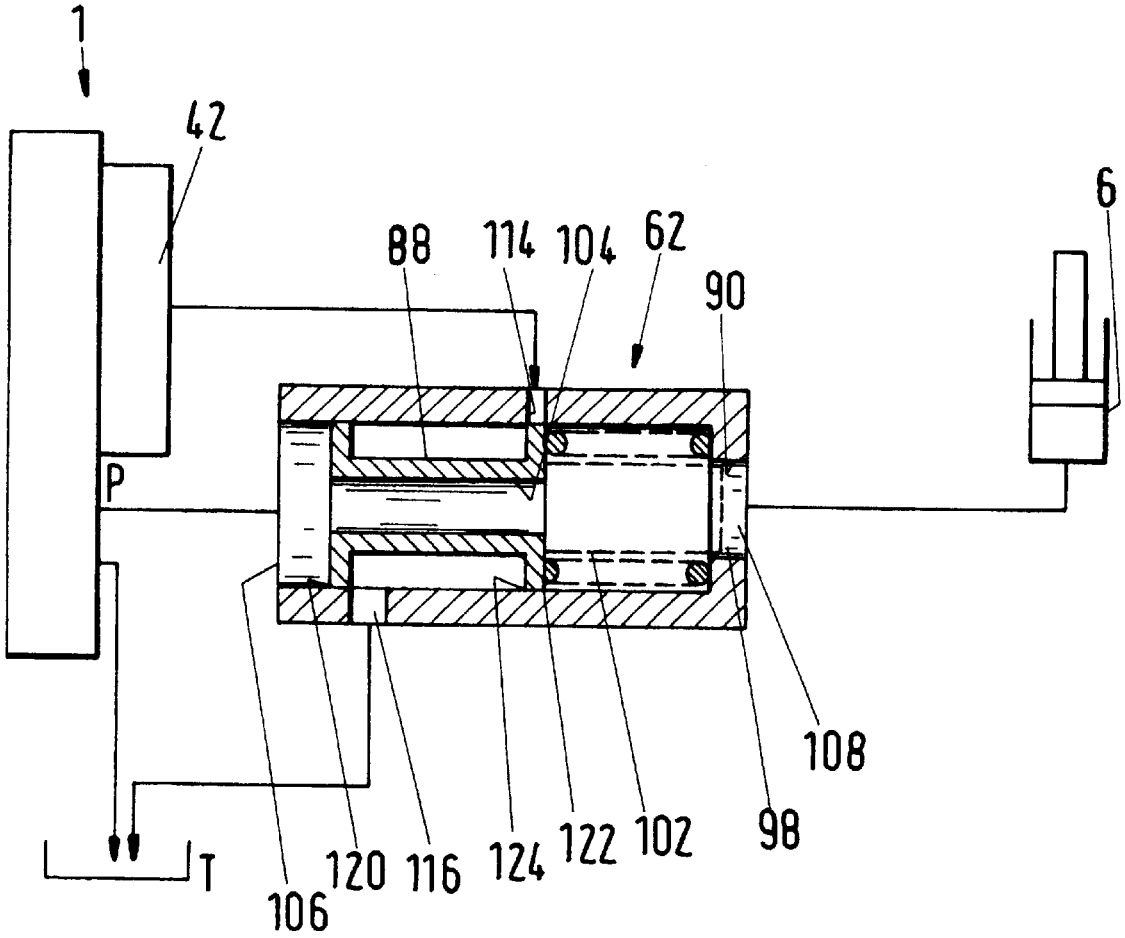
FIG. 6 is a schematic illustration of a further embodiment of a control valve for a positive displacement machine according to the invention.

FIG. 6 shows a further embodiment represented in a simplified illustration in comparison to FIG. 5 of a control valve 62 according to the invention. This control valve 62 has substantially the same configuration as that of the embodiment in FIG. 5 so that in the following only the differences will be discussed. In FIG. 6 the piston 88 is shown in the control positions in which the control connector 114 is closed by the control edges 122 and 124 (zero overlap). Upon further axial movement of the piston 88 to the right, the control connector 114 is first opened by the control edge 124 and, finally, the connector 106 is opened by the control edge 120 to the return connector 116. In this respect, this embodiment corresponds to that of FIG. 5. An important difference is that the control connector 114 is connected via the control edge 122 to the outlet connector 108 and not, as in the embodiment represented in FIG. 5, to the inlet connector 106. This is achieved in the embodiment illustrated in FIG. 6 in that no mantle bore 118 is provided and in that a hydraulic connection between the spring chamber 102 and the control connector 114 can be provided via the control edge 122.

As indicated in dashed lines in FIG. 6, the piston 88 can also be embodied with a radially recessed end portion 98 which cooperates with the damping bore 90. However, in this case measures would have to be taken in order to guide the hydraulic medium unhindered from the metering orifice bore 104 to the outlet connector 108.

In the embodiment represented in FIG. 6 the return connector 116 is connected to the tank T. When the piston 88 has reached the control position illustrated in FIG. 6, the control connector 114 is covered with zero overlap so that the pressure in the pressure field at the backside of the pressure plate has exactly the right level. Upon further increase of the conveying volume flow, the pressure at the backside is reduced because of return flow of oil from the control connector 114 to the return connector 116. Finally, the connector 106 is connected via the control edge 120 to the return connector 116, and the hydraulic medium is returned directly into the tank T.

Because of the lifting of the pressure plate 42 the conveying flow is lowered so that the piston 88 can be moved back into the represented control position. Upon further lowering of the conveying flow the control edge 122 opens the connection to the connector 108 so that the pressure plate is pretensioned in its contact position and the sealing gap is decreased - the conveying flow increases again.

An important advantage of the invention is that the control valve 62 is received in that area of the housing 30 which has a greater wall thickness, because of the eccentric arrangement of the receptacle 32, than the area of the housing wall positioned in the upper half of FIG. 2. Because of the tangential arrangement of the pressure channel 64 it can be easily produced by drilling from the outside so that, moreover, the technological expenditure with respect to manufacture is minimal.

The control valve 62 according to the invention can be used, in principle, in a plurality of displacement machine types, for example, in vane cell pumps, gear pumps, and the corresponding motor configurations.

Disclosed is a hydraulic positive displacement machine in which the sealing action at the end faces of rotating conveying elements is realized by a pressure plate. This pressure plate is loaded by a control valve with a pressure by which the size of the sealing gap can be influenced. According to the invention, the control valve has a hollow piston forming a metering orifice via which a return connector, a connector to the consumer, and a control connector hydraulically connected to the pressure plate can be controlled.

While specific embodiments of the invention have been shown and described in detail to illustrate the inventive principles, it will be understood that the invention may be embodied otherwise without departing from such principles.

What is claimed is:

1. A hydraulic positive displacement machine comprising:

a housing (30, 52) having housing walls defining a housing interior (32);

said housing walls having an intake opening (46) and an outlet opening (50);

conveying elements (34, 36) mounted in said housing interior (32) and configured to convey a hydraulic medium from said intake opening (46) through said housing interior (32) to said outlet opening (50) and to expel the hydraulic medium under pressure from said outlet opening (50);

said conveying elements (34, 36) having end faces;

at least one pressure plate (42) acting on said end faces of said conveying elements (34, 36) to seal said conveying elements (34, 36);

a control device (14, 16; 62) configured to control a pressure loading said at least one pressure plate (42) into a sealing position against said end faces of said conveying elements (34, 36);

said control device (14, 16; 62) having a control valve (62);

said control valve (62) having a valve housing (84) and a piston (88) reciprocatingly mounted in said valve housing (84);

said control valve (62) having a pressure connector arrangement, comprised of an inlet connector (106) and an outlet connector (108);

said piston (88) having a throughbore with a metering orifice bore (104) connecting said inlet connector (106) and said outlet connector (108) with one another;

a spring (100) mounted in said valve housing (84) and resting against said piston (88) and an inner wall of said valve housing (84);

wherein said piston (88) is loaded by a first pressure of the hydraulic medium upstream of said metering orifice bore (104) and a second pressure of said hydraulic medium downstream of said metering orifice bore (104) and is moreover biased by said spring (100);

said valve housing (84) having a control connector (114) hydraulically connected to said at least one pressure plate (42) and a return connector (116) for the hydraulic medium;

wherein, depending on a pressure differential (Δp) of said first and second pressures, said control connector (114) is configured to be connected via said piston (88) to said pressure connector arrangement (106, 108) for increasing pressure on said pressure plate (42) and to be connected to said return connector (116) for reducing the pressure on said pressure plate (42).

2. The hydraulic positive displacement machine according to claim 1, wherein said piston (88) has a first annular collar (94) and wherein said first annular collar (94) has a first control edge (122), configured to control communication of said control connector (114) and said pressure connector arrangement (106,108), and a second control edge (124), configured to control communication of said control connector (114) and said return connector (116).

3. The hydraulic positive displacement machine according to claim 2, wherein said control valve (62) has a cross-section element (110) that is opened by said piston (88) when a limit pressure is surpassed for connecting a flow section (4, 20) of said hydraulic positive displacement machine upstream of said metering orifice bore (104) to said return connector (116).

4. The hydraulic positive displacement machine according to claim 3, wherein said piston (88) has a second annular collar (92) spaced from said first annular collar (94), wherein said second annular collar (92) has a third control edge (120) for controlling said cross-section element (110).

5. The hydraulic positive displacement machine according to claim 1, wherein said piston (88) has a stepped throughbore with a first bore portion having a smaller bore diameter than a second bore portion and wherein said metering orifice bore (104) is defined by said first bore portion.

6. The hydraulic positive displacement machine according to claim 5, wherein said piston (88) has an end portion (98) having a reduced outer diameter, said valve housing (84) has a damping bore (90), and said end portion (98) is received in said damping bore (90) so that a damping gap is defined between said end portion (98) and said damping bore (90), wherein said spring (100) is arranged about said end portion (98) in an axial area between said damping gap and a shoulder of said end portion (98) remote form said damping gap.

7. The hydraulic positive displacement machine according to claim 5, wherein said piston (88) has a radial bore (118) opening into said throughbore upstream of said metering orifice bore (104), wherein said radial bore (118) is configured to supply hydraulic medium to said control connector (114).

8. The hydraulic positive displacement machine according to claim 7, wherein said piston (88) has a third collar (96) defining said shoulder of said end portion (98), wherein said third collar (96) is spaced from said first collar (94) and is guided sealingly on an inner wall of an axial bore (86) of said valve housing (84).

9. The hydraulic positive displacement machine according to claim 1, wherein said control valve (62) has a spring chamber (102) in which said spring (100) is mounted and wherein said control valve (62) is configured such that hydraulic medium is guided downstream of said metering orifice bore (104) through said spring chamber (102) into said control connector (114).

10. The hydraulic positive displacement machine according to claim 1, wherein said conveying elements (34, 36) are formed by an internal gearwheel (34) and a meshing pinion (36) eccentrically arranged relative to one another, wherein said internal gear wheel (34) and said meshing pinion (36) form an internal gear wheel machine having a high pressure area (40) and a low pressure area (38), wherein said control valve (62) is positioned radially outside of said high pressure area (40).

11. The hydraulic positive displacement machine according to claim 10, wherein said housing (30) has a tangentially extending pressure channel (64) connected to said outlet opening (50) and a pressure connector of said internal gear wheel machine, and wherein said control valve (62) is arranged in said pressure channel (64).

12. The hydraulic positive displacement machine according to claim 10, further comprising a return channel (72, 74) connecting said return connector (116) to said low pressure area (38).

13. The hydraulic positive displacement machine according to claim 1, wherein a surface area of said intake opening (46) is approximately 20% to 40% of a theoretical surface area for a maximum conveying volume.

14. The hydraulic positive displacement machine according to claim 13, wherein said surface area of said intake opening (46) is approximately 30% of said theoretical surface area.

15. A return valve for a hydraulic positive displacement machine according to claim 1, comprising a sleeve (84) having an axial bore (86) and a piston (88) moveably guided in said axial bore (86), said sleeve (84) having a control connector (114) formed by one or more radial bores in said sleeve (84) and opening into said axial bore (86) and a radial connector (116) formed by one or more radial bores in said sleeve (84) and opening into said axial bore (86), wherein said axial bore (86) has an inlet connector (106) and an outlet connector (108) defining a pressure connector arrangement, wherein said piston (88) has a metering orifice bore (104) connecting said inlet connector (106) and said outlet connector (108) with one another, wherein said piston (88) has control edges (122, 124), configured to control communication of said control connector (114) with said pressure connector arrangement (106, 108) and with said radial connector (116).

16. The return valve according to claim 15, wherein said control connector (114) is configured to be hydraulically connected with an area upstream of said metering orifice bore (104) and an area downstream of said metering orifice bore (104).

* * * * *